US010327080B2

(12) United States Patent
Probst

(10) Patent No.: US 10,327,080 B2
(45) Date of Patent: Jun. 18, 2019

(54) METHOD OF MANUFACTURING HEARING DEVICES

(75) Inventor: Daniel Probst, Zurich (CH)

(73) Assignee: SONOVA AG, Staefa (CH)

( * ) Notice: Subject to any disclaimer, the term of this patent is extended or adjusted under 35 U.S.C. 154(b) by 727 days.

(21) Appl. No.: 13/133,989

(22) PCT Filed: Dec. 19, 2008

(86) PCT No.: PCT/EP2008/068057
§ 371 (c)(1),
(2), (4) Date: Jun. 10, 2011

(87) PCT Pub. No.: WO2009/068696
PCT Pub. Date: Jun. 4, 2009

(65) Prior Publication Data

US 2011/0258839 A1 Oct. 27, 2011

(51) Int. Cl.
*H04R 31/00* (2006.01)
*H04R 25/00* (2006.01)

(52) U.S. Cl.
CPC ..... *H04R 25/652* (2013.01); *H04R 25/658* (2013.01); *H04R 2225/77* (2013.01); *H04R 2460/11* (2013.01); *Y10T 29/49005* (2015.01)

(58) Field of Classification Search
CPC ..... H04R 2225/77
USPC ..... 700/98
See application file for complete search history.

(56) References Cited

U.S. PATENT DOCUMENTS

RE34,961 E * 6/1995 Widin et al. ..... 703/6
5,825,894 A * 10/1998 Shennib ..... 381/60
6,731,997 B2 * 5/2004 Hessel et al. ..... 700/98
7,162,323 B2 * 1/2007 Brumback et al. ..... 700/118
(Continued)

FOREIGN PATENT DOCUMENTS

AU 2000272656 B2 4/2002
EP 1729231 A1 12/2006
(Continued)

OTHER PUBLICATIONS

American Speech-Language-Hearing Association. (1999). "Joint audiology committee clinical practice statements and algorithms [Guidelines]." Available from www.asha.org/policy.*
(Continued)

*Primary Examiner* — Emilio J Saavedra
(74) *Attorney, Agent, or Firm* — Pearne & Gordon LLP

(57) ABSTRACT

A method of manufacturing hearing devices comprising an otoplastic individually shaped for a user includes providing input data for each set of input parameters of an algorithm for determining target data for each of a set of target parameters, wherein at least a portion of said input data are individual to said user, and wherein said target parameters are parameters related to the geometrical and/or acoustical properties of a hearing device. The target data is determined by applying the algorithm to the input data. A suitable three-dimensional shape of the otoplastic is designed in dependence of the target data by means of otoplastic modeling software. The otoplastic is manufactured according to the suitable three-dimensional shape. Property data descriptive of properties related to the manufactured otoplastic are obtained using the otoplastic, and the algorithm is amended in dependence of the property data.

16 Claims, 1 Drawing Sheet

(56) References Cited

U.S. PATENT DOCUMENTS

| | | | | |
|---|---|---|---|---|
| 2003/0021434 | A1 | 1/2003 | Hessel et al. | |
| 2004/0107080 | A1* | 6/2004 | Deichmann et al. | 703/6 |
| 2006/0233384 | A1* | 10/2006 | Bachler et al. | 381/60 |
| 2007/0135862 | A1* | 6/2007 | Nicolai | A61N 1/36032 607/56 |

FOREIGN PATENT DOCUMENTS

| | | | |
|---|---|---|---|
| EP | 1843634 | A2 | 10/2007 |
| WO | 02/25993 | A1 | 3/2002 |

OTHER PUBLICATIONS

Amlani et al., "Methods and Applications of the Audibility Index in Hearing Aid Selection and Fitting" Trend in Amplification vol. 6 No. 3 2002.*

Dillon, "NAL-NL1: A new procedure for fitting non-linear hearing aids" The Hearing Journal vol. 52, No. 4. Apr. 1999. pp. 10,12,14,16.*

International Search Report for PCT/EP2008/068057 dated Sep. 2, 2009.

Written Opinion for PCT/EP2008/068057 dated Sep. 2, 2009.

* cited by examiner

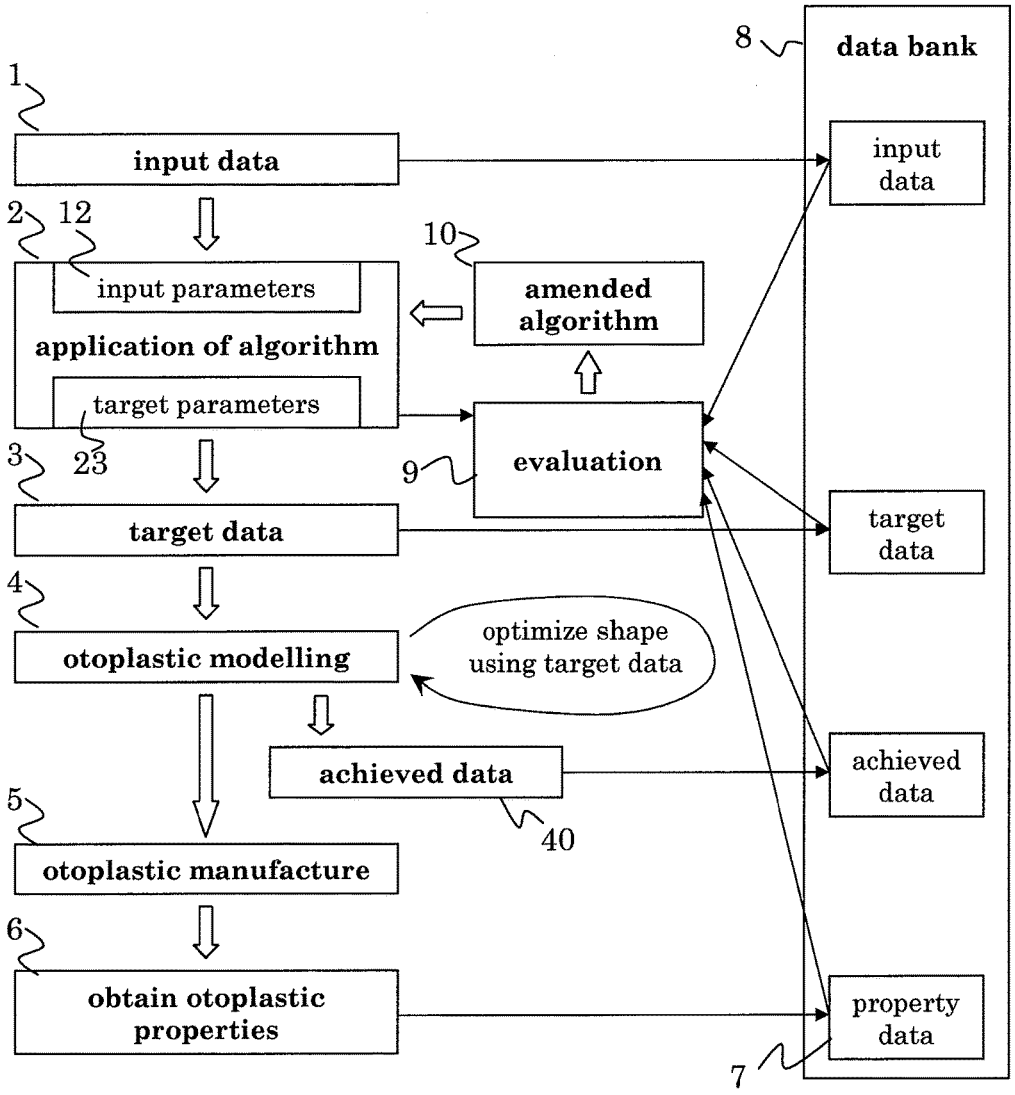
8
data bank
1
input data
input data
2
12
10
input parameters
amended algorithm
application of algorithm
target parameters
23
3
9
evaluation
target data
target data
4
otoplastic modelling
optimize shape using target data
achieved data
achieved data
40
5
otoplastic manufacture
6
obtain otoplastic properties
property data
7

METHOD OF MANUFACTURING HEARING DEVICES

TECHNICAL FIELD

The invention relates to the field of hearing devices and in particular to their manufacture. It relates to methods according to the opening clauses of the claims.

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear (BTE), in the ear (ITE), partly or completely in the ear canal (ITC, CIC) or may be implanted.

BACKGROUND OF THE INVENTION

From AU 2000 272656 C1, hearing devices are known, which comprise an otoplastic which comprises an acoustic conductor such as a vent, which is fully integrated in the otoplastic, and it is suggested to provide varying cross-sectional areas along the extension of the vent.

An otoplastic (also referred to as otoplasty) is worn in the ear of the hearing device user, more precisely at least in part in the ear canal. In case of BTE hearing devices, the otoplastic is also referred to as ear mold and usually does not contain electronic components or converters, but may do so. In case of ITE hearing devices, in particular ITC and CIC hearing devices, the otoplastic is also referred to as ear shell or shell and usually comprises sound processing circuits as well as input and output converters.

A vent is a channel-like opening in an otoplastic, which is usually meant to equalize pressure differences between the inside of the ear canal and the outside.

SUMMARY OF THE INVENTION

One object of the invention is to create an improved method of manufacturing hearing devices comprising an individually shaped otoplastic. The otoplastic is individually shaped for a user to be using the respective hearing device.

Another object of the invention is to provide an improved method of manufacturing an individually shaped otoplastic of a hearing device.

Another object of the invention is to provide a method of manufacturing hearing devices comprising an individually shaped otoplastic, which tends to yield hearing devices which particularly well suit the needs of the individual hearing device user.

Another object of the invention is to provide a method of manufacturing hearing devices comprising an individually shaped otoplastic, which tends to yield hearing devices which have particularly advantageous acoustical properties.

Another object of the invention is to provide a method of manufacturing hearing devices which more reliably and/or more predictably yields hearing devices which particularly well suit the needs of the individual hearing device user.

Further objects emerge from the description and embodiments below.

At least one of these objects is at least partially achieved by methods according to the patent claims.

The method of manufacturing hearing devices comprising an otoplastic individually shaped for a user to be using the respective hearing device comprises the steps of a) providing input data for each of a set of input parameters of an algorithm for determining target data for each of a set of target parameters, wherein at least a portion of said input data are individual to said user, and wherein said target parameters are parameters related to geometrical and/or acoustical properties of a hearing device;
b) determining said target data by applying said algorithm to said input data;
c) designing a suitable three-dimensional shape of said otoplastic in dependence of said target data by means of an otoplastic modelling software;
d) manufacturing said otoplastic according to said suitable three-dimensional shape;
e) obtaining property data using said otoplastic, wherein said property data are descriptive of properties related to said manufactured otoplastic;
f) amending said algorithm in dependence of said property data.

Through this, it is possible to reliably manufacture well-fitting hearing devices and even to provide an improvement in time of the quality of the fit of the manufactured hearing devices, in particular of the manufactured otoplastics; i.e. the longer the method is applied, the better will be the achieved fit of the respective otoplastics and hearing devices, respectively. And the method makes it possible to manufacture hearing devices, which are particularly well-fitted or at least well-fittable from an acoustical point of view, and also this is very likely to improve in time.

Typically, step b) is carried out in an automated fashion, usually using a software in which the algorithm is embodied.

Note that the shape designed in step c) depends on the target data, wherein the target data are derived by the algorithm (step b) fed with the input data. The three-dimensional shape mentioned in step c) is referred to as suitable three-dimensional shape in order to distinguish it from other three-dimensional shapes that might come up during the designing (step c); this particular shape is expected to fit the hearing device user very well and, accordingly, it is used for the following manufacturing step (step d).

Note that the amendment of the algorithm (step f) is usually meant to provide an improvement of the algorithm, usually in the sense that hearing devices manufactured using the amended algorithm will better fit their respective users.

The use of said algorithm and the target parameters can lead to the manufacture of otoplastics which provide at least one of an optimized size and shape of the otoplastic,
an optimized occlusion reduction,
an optimized feedback reduction,
an optimized low frequency gain,
an optimized amount of direct sound, and in particular a combination of three or four of these magnitudes which very well fits the needs of the hearing device user.

Note that, in the present patent application, it is attempted to distinguish as clearly as possible between parameters and data of parameters. Said data of parameters can also be referred to as settings of parameters or parameter settings. A parameter is representative of a certain magnitude or quality such as a length, an acoustic mass or the like; whereas the data (parameter settings) which are assigned to a parameter indicate a quantity or value which is assumed by the parameter, such as 2 cm, 5000 kg/m$^4$. In many cases, the data are values.

In one embodiment, said target parameters are parameters related to geometrical and/or acoustical properties of an otoplastic.

In one embodiment, the method comprises, in addition, the step of r) carrying out again steps a) to d), in particular steps a) to e), wherein in steps a) and b) it is referred to the algorithm as obtained in step f).

In other words, the method comprises manufacturing at least one further hearing device according to the method, using the amended algorithm.

In one embodiment, the input data comprise data related to an audiogram of said user, in particular data descriptive of an audiogram of said user. From an audiogram, many values can be deduced which relate to desirable properties of the otoplastic.

In one embodiment, the input data comprise data descriptive of the geometry of the shape of the user's ear canal. Such data are readily obtained, e.g., in the standard way using an imprint of the user's ear canal.

In one embodiment, the input data comprise data descriptive of the type of hearing device to be manufactured, e.g., data indicating that a CIC, or that an ITC shall be manufactured.

In case that the hearing device to be manufactured is of type ITE, ITC or CIC, the otoplastic is also referred to as shell, while in case of BTE hearing devices, it is also referred to as mold.

The invention is of particular importance in case of ITE, ITC and CIC type hearing devices, because of the very limited amount of space available in the corresponding otoplastics.

In one embodiment, the manufacturing mentioned in step d) comprises using a rapid prototyping method such as laser sintering, laser lithography/stereolithography or a thermojet method. In the before-mentioned publication AU 2000 272656 C1, several suitable rapid prototyping methods are mentioned and described; for details it is referred to said publication and the corresponding references cited therein.

In one embodiment, said amending mentioned in step f) is carried out also in dependence of said target data.

In one embodiment, said amending mentioned in step f) is carried out also in dependence of said input data.

In one embodiment, said designing mentioned in step c) comprises the steps of k1) designing a preliminary three-dimensional shape of said otoplastic;

k2) determining for said preliminary three-dimensional shape the data for said target parameters, said data being referred to as achieved data;

k3) repeating steps k1) and k2) until a preliminary three-dimensional shape is found, which fulfills a predetermined criterion indicative of a sufficient agreement between said achieved data and said target data;

k4) selecting the preliminary three-dimensional shape found in step k3) as the suitable three-dimensional shape of said otoplastic mentioned in step d).

In one embodiment, said determining mentioned in step k2) comprises calculating at least a portion of said achieved data (based on said preliminary three-dimensional shape). This will typically be the case for target parameters descriptive of, representative of or representable by geometrical properties.

In one embodiment, said determining mentioned in step k2) comprises determining at least a portion of said achieved data by means of numerical simulation (based on said preliminary three-dimensional shape). This will typically be the case for target parameters descriptive of, representative of or representable by acoustical properties.

In one embodiment, step k2) is carried out by said otoplastic modelling software. In other words, said otoplastic modelling software will determine—usually automatically or upon a request of the user of the otoplastic modelling software—said achieved data.

In one embodiment, said amending mentioned in step f) is carried out also in dependence of said achieved data.

In one embodiment, at least one of said target parameters is descriptive of a transfer function of said hearing device or of an approximation to said transfer function. In one embodiment, this transfer function relates to a mechanical/acoustical signal path involving the hearing device. In one embodiment, this transfer function relates not to an electrical signal path inside the hearing device (electric transfer function).

In one embodiment, at least one of said target parameters is descriptive of an acoustic impedance.

In one embodiment, at least one of said target parameters is descriptive of an acoustic mass. The acoustic mass is an acoustical quantity, which is closely linked to geometrical properties. For a straight vent of a length l and a cross-sectional area A, the acoustical mass Ma is given as $$Ma = 1.18\ (\mathrm{kg/m^3})\cdot(l/A).$$

And, e.g., for a straight vent having sequentially arranged sections of lengths $l_i$ and cross-sectional areas $A_i$, the following proportionality applies for the acoustical mass Ma:

$$Ma \sim \sum_i \frac{l_i}{A_i}$$

In one embodiment, at least a portion of said property data is descriptive of properties related to said otoplastic inserted in an ear of said user. Since the otoplastic is inserted in an ear of said user during its normal operation, properties such as, e.g., the rest volume between the otoplastic and the user's ear drum, are of great importance for the performance of the hearing device.

In one embodiment, at least a portion of said property data is descriptive of properties related to said otoplastic inserted in an ear model. Inserted in an ear model such as the well-known KEMAR or the standard 2 cc coupler, properties can be determined which are close to the properties determined with the otoplastic inserted in an ear of the user, but the user does not have to be present during determining the properties.

In one embodiment, at least a portion of said property data is descriptive of properties related to said otoplastic when it is not inserted. Properties determined at a free otoplastic are—in case of acoustical properties—usually of limited value, but, e.g., geometrical data can easily and precisely be determined.

In one embodiment, at least a portion of said property data is descriptive of a feedback threshold of said hearing device inserted in an ear of said user. The feedback threshold, usually measured continuously or at many different frequencies over a frequency range, is an important measure, since feedback is undesired and limits the maximum applicable gain of the hearing device. Furthermore, the feedback threshold is closely related to the design of the otoplastic, in particular to the design of vents. The feedback threshold is measured by increasing the amplification of the hearing device when the hearing device is inserted in an ear of said user until the typical feedback howling starts.

In one embodiment, at least a portion of said property data is descriptive of an insertion gain (active or passive insertion gain) of said hearing device. The active insertion gain and passive insertion gain, respectively, can be determined by comparing the sound pressure levels caused by an external sound source as measured at the tympanic membrane for the case that the hearing device inserted in the hearing device user's ear and the case that the hearing device is not inserted in the hearing device user's ear, wherein the inserted hearing device is switched on (active insertion gain) and switched off (passive insertion gain), respectively.

The passive insertion gain is usually negative, since the insertion of a passive hearing device into an ear canal of a user typically results in an attenuation of the sound pressure level at the tympanic membrane.

The measurement of the passive insertion gain reveals, to which extent the ear canal is closed off by the inserted hearing device.

A comparison of active insertion gain and feedback threshold gives an indication as to how close to the feedback threshold the hearing device operates, i.e. how sensitively the hearing device will react with respect to changes in the feedback path.

In one embodiment, step c) comprises the step of designing the shape and size of an opening in said otoplastic, wherein said opening is one of

- a vent;
- a hollow in said otoplastic forming a channel from the outside of the hearing device to an input transducer of the hearing device;
- a hollow in said otoplastic forming a channel from an output transducer of the hearing device to the outside of the hearing device.

The shape and size of these openings, which are usually channel-like, is closely related to the acoustic properties of the otoplastic.

Said input transducer is or comprises typically an input mechanical-to-electrical converter, in particular an acoustical-to-electrical converter, e.g., a microphone.

Said output transducer is or comprises typically an output electrical-to-mechanical converter, in particular an electrical-to-acoustical converter, e.g., a loudspeaker, usually referred to as receiver in the field of hearing devices.

In one embodiment, step c) comprises the step of designing the shape, size and location of an opening in said otoplastic to the outside which forms a portion of a vent of said hearing device, and which is arranged between two portions of said vent which are enclosed by said otoplastic.

It turned out that—in particular in case of very small otoplastics such as in the case of CIC hearing devices—it is possible to provide a relatively small acoustic mass of a vent by providing between two channel-like portions of the vent a portion of the vent which is open to the ear canal. The size and shape of this portion is important for the acoustic performance of the hearing device. In that portion, the circumference of the vent is not completely formed by the otoplastic, but the user's ear canal provides a portion of the boundary of the vent. The cross-sectional area of such a portion of a vent can be relatively large compared to a portion where the cross-section is fully enclosed by material of the otoplastic.

In one embodiment, said amending mentioned in step f) comprises evaluating those data in dependence of which said amending said algorithm is carried out. In such an evaluation, data can be compared or statistically analyzed (in particular if data from many different hearing device manufacturing processes are involved), or other types of computation and calculation can be carried out on the data. Besides the above-mentioned data in dependence of which said amending said algorithm is carried out, also data indicative of the algorithm used during step b) can be considered in this evaluation. Such data may, e.g., indicate a version number of the algorithm or describe the algorithm itself. The evaluation allows to make particularly efficient amendments to the algorithm (step f).

In one embodiment, the method comprises the step of storing in a common storage unit at least a portion of those data (preferably all those data) in dependence of which said amending said algorithm is carried out. Said data can, e.g., be stored in a data base. Usually, said common storage unit is accessible by the hearing device manufacturer, enabling said manufacturer to evaluate said data for said amending said algorithm or for other purposes.

Furthermore, it is possible that at least a portion of said data is accessible to the hearing device fitter. E.g., said portion of said data may be stored in a storage unit at the hearing device fitter's office, or the fitter may have remote access to said portion of said data, enabling the fitter to evaluate said portion of said data in order to improve his services to his customers or in order to improve and/or support his reporting back to the hearing device manufacturer. Said reporting back may include, but is not limited to, the reporting of strengths and weaknesses of particular hearing devices, requests for product improvements, recommendations as to how end user counseling or business processes may be improved.

Finally, it is alternatively or additionally possible to store in the hearing device itself at least a portion of those data in dependence of which said amending said algorithm is carried out, in particular the target data and the achieved data and possibly also at least a portion of the input data. This provides the advantage that the stored information is available wherever the hearing device is located, be it at the user's home or work place or at the fitter's office or at a distributor's or the manufacturer's premises, e.g., when the hearing device is turned in for service or repair. In this case, there is no need for internet connectivity or the like.

In one embodiment, said amending mentioned in step f) comprises at least one of

- defining an amended set of input parameters;
- amending the dependency of the target data on the input data;
- defining an amended set of target parameters.

This allows to provide very comprehensive and flexible amendments of the algorithm. In many cases, the functional dependency of the target data on the input data will be changed when making amendments according to step f).

Viewed from a particular point of view, the method according to the invention can be considered a method of manufacturing otoplastics of hearing devices, which otoplastics are individually shaped for a user to be using the respective hearing device.

Further embodiments and advantages emerge from the dependent claims and the figures.

BRIEF DESCRIPTION OF THE DRAWINGS

Below, the invention is described in more detail by means of examples and the included drawing. The FIGURE shows:

FIG. 1 a block diagrammatical illustration of a method according to the invention.

The described embodiments are meant as examples and shall not confine the invention.

DETAILED DESCRIPTION OF THE INVENTION

FIG. 1 shows a block diagrammatical illustration of a method according to the invention. The method is a method of manufacturing hearing devices comprising an otoplastic individually shaped for a user to be using the respective hearing device.

In a first step, input data 1 are provided, such as an audiogram of said user, geometry data of the user's ear canal, data indicating whether a CIC or another type of hearing device shall be manufactured. These input data are stored in a storage unit 8, e.g., in a data bank, and/or in the hearing device itself. The input data are settings of a set of input parameters 12 of an algorithm to which they are fed. The algorithm will be executed using said input data (see 2). This will usually be accomplished using a computer, typically a computer connected to said storage unit 8, on which computer a software embodying the algorithm is running.

The algorithm has target parameters 23. Applying the algorithm to said input data 1 will result in an assignment of target data 3 to the target parameters 23. This is the output of the algorithm. These target data 3 will be stored in storage unit 8. A target parameter 23 can be, e.g., an acoustical mass of a vent of the hearing device, a vent type (e.g., constant cross section/conical/stepwise changes; shape of the cross section such as round/rectangular/d-shaped), a receiver to be used, a microphone to be used, insertion gain characteristics, feedback threshold.

Then, an otoplastic modelling software is used, which allows to three-dimensionally design the shape of the otoplastic to be manufactured (see 4). Such kind of modelling software is known and widely used.

The target data 3 are inputted to said otoplastic modelling software, and the otoplastic design is made in dependence of these target data 3. For this, parameter values determinable for a modelled otoplastic will be determined (preferably by the otoplastic modelling software) and compared to said target data 3. Accordingly, at least a portion of the determined data will usually be settings (data) of at least a portion of the target parameters. It is attempted to achieve a good agreement between the determined data and the corresponding target data 3. Determining said (determined) data can be accomplished by calculating them, as it would be the case when determining, e.g., the acoustic mass of a vent in the otoplastic, or they can be obtained by (numerical) simulations or in another way, e.g., when more complex acoustical properties have to be determined.

Usually, a first otoplastic design will be made, and then data for said target parameters 23 of this first design will be determined and compared to the target data 3. Then, an amended design will be made, and the corresponding new data for the target parameters 23 of this amended (second) design will be determined and compared to the target data 3. This will be repeated until an otoplastic has been designed which has data for the target parameters 23 which are considered sufficiently close to the target data 3; these data will be referred to as achieved data 40, and they will be stored in a storage unit 8.

Then, an otoplastic is manufactured (see 5) according to the so-achieved otoplastic design, referred to as suitable otoplastic design, because it is a design which is expected to particularly well suit the needs of the hearing device user.

Using the so-manufactured otoplastic, properties related thereto, in particular properties thereof can be determined (see 6). Some properties may be measurable at the otoplastic alone, some require that the hearing device electronics or other units, in particular parts of the hearing device, are present in order to be able to determine the properties. Some property data may describe the feedback threshold, some may describe the acoustic mass of a vent of the hearing device, and some may describe the passive or active insertion gain, measured in an artificial or in a real ear.

Some property data may even be descriptive of how content the hearing device user is with the otoplastic and/or with the hearing device and/or its performance. Some property data may even be descriptive of how content the hearing device fitter is with the otoplastic or with the hearing device, e.g., how well the fitting worked, or may comprise other remarks.

The so-obtained property data 7 will be stored in the storage unit 8, too.

An important point is that, based on at least a portion of the data stored in storage unit 8, the algorithm will undergo a change, so as to derive an amended algorithm 10. That amended algorithm 10 can then be used in further otoplastics design steps and hearing device manufacturing steps.

In order to determine what it is that should be amended about the algorithm, so as to be able to manufacture better otoplastics and better hearing devices, usually an evaluation (see reference symbol 9) of at least a portion of said input data 1,
said target data 3,
said achieved data 40,
said property data 7 will be carried out.

Examples for input data are:
- audiogram data, in particular hearing loss data;
- description of listening situations that are most often encountered by the hearing device user;
- the hearing device user's ear canal geometry;
- the user history (e.g., allowing to distinguish between first time users of a hearing device and experienced hearing device users);
- user preferences (e.g., indicating that the user prefers a soft sound).

Examples for target data are:
- target active insertion gain;
- target passive insertion gain;
- target feedback threshold;
- target acoustical vent mass;
- target shape of otoplastic;
- target data of loudspeaker (receiver) to be used;
- target data of microphone(s) to be used.

The following describes an example of how evaluations (cf. reference symbol 9) and amendments (cf. reference symbol 10) can be carried out.

The algorithm (cf. reference symbol 2) linking input data 12 to target data 23 may comprise a formula determining an active insertion gain from hearing loss data. A simple example: If the hearing loss at a particular frequency is 50 db, the active insertion gain at this frequency should be 50 db in order to compensate for the hearing loss. More sophisticated ways to do so, i.e. more sophisticated gain models, may take into account, e.g.:

- the need to reduce gain at high input levels;

the user history (e.g., in order to provide only a partial compensation of hearing loss for first time hearing device users); and user preferences (e.g., for reducing high-frequency gain if the user prefers soft sound).

Based on the so-determined active insertion gain, which is identified with the target active insertion gain, the algorithm may be designed to determine a first approximation to the acoustic vent mass, and therefrom, determine a first approximation to the passive insertion gain. From a combined consideration of the target active insertion gain and the first approximation to the passive insertion gain, a first acoustic transfer function can be determined. Taking into account this first acoustic transfer function, the performance of a feedback canceller provided in the hearing device and a minimum gain reserve required for stable operation, the algorithm may determine a first approximation to the feedback threshold.

In a next step, the algorithm may determine, e.g., based on a lookup table or on some other empirically determined functional dependency, whether or not the first approximation to the feedback threshold is inconsistent with the first approximation to the acoustic vent mass, i.e. whether or not the latter is too small or too large. The algorithm may then determine a second approximation to the acoustical vent mass, derive a second approximation to the passive insertion gain and a second approximation to the feedback threshold, and check for consistency with the second approximation to the acoustical vent mass. This iterative process will continue until sufficient consistency between the approximation to the feedback threshold and the approximation to the acoustical vent mass is obtained. The so-determined approximation values for acoustical vent mass, passive insertion gain, acoustic transfer function and feedback threshold will be identified with the respective target values (target data).

Based on the characteristics of the target acoustic transfer function, a suitable microphone and receiver may be selected, either manually by an operator or automatically by the algorithm. The specifications of the selected microphone and receiver, in particular their mechanical dimensions, but possibly also their electro-acoustical properties, may be included in the set of target data, too.

The evaluation and amendment can possibly be at least partially automated. Currently, it is envisaged that most of the evaluation and the amending of the algorithm is carried out by a person, with the help of a computer.

It is to be noted that the data 1, 3, 40, 7 can be stored at least partially in separate storage devices.

The invention allows to continually improve the manufacture of well-fitting hearing devices and otoplastics. The invention is particularly valuable in the design of vents and other openings, in particular channel-like openings, in otoplastics. These can in many cases be designed rather freely (where exactly start and end points are, lengths of channel, shape and size of cross-section and variation of cross-section over length of channel) and have a rather strong influence on the acoustic performance of a hearing device. Note that the outer shape of an otoplastic is to a large extent given by the user's ear canal geometry.

With respect to the design of vents, the following is to be noted: Nowadays, vents are usually simple tube-shaped channels having a circular cross-section of constant diameter. This usually does not result in particularly space-efficient otoplastic designs. The length of the channel and the diameter are usually prescribed by the hearing device professional (such as an audiologist or hearing device fitter), who basically relies on his knowledge and experience in that matter. Accordingly, this way of determining crucial parameters of the vent (length and cross-sectional area) depends strongly on the hearing device professional, is not very reproducible, does not fully use the available design possibilities (such as different cross-section shapes and varying cross-sections along the length of the vent), and—in most cases—will neglect some available relevant parameters. By means of the algorithm and the target-parameter dependent otoplastic design, these drawbacks can, at least in part, be overcome. And by the above-described amending of the algorithm, the process can be continually improved, so as to refine the process and include new findings and the experience gained from former hearing device manufacturing processes.

It is to be noted that it can also be very valuable to make use of at least a portion of those data, which are stored in storage unit 8 when fitting the electronic transfer function of the hearing device (not shown in FIG. 1). In particular, it is possible to select those signal processing settings, which are firstly used in the hearing device (initial signal processing parameter settings), in dependence of at least a portion of said input data 1, said target data 3, said achieved data 40, said property data 7;

in particular in dependence of at least one of said data 3, 40, 7.

A corresponding method of adjusting the electronic transfer function of a hearing device to the needs of a user of the hearing device can be very valuable, because a particularly good starting point for the usually long and tedious fitting procedure of finding suitable sound processing parameters can be determined this way.

The acoustic mass of a vent or any other approximation to or characterization of an acoustic transfer function available from the achieved data or from the property data, and also feedback threshold data available from the property data (measured before the first fit of the electric transfer function) turned out to be of particularly high value during the determination of the initial signal processing parameter settings.

The invention claimed is:

1. A method of adjusting a transfer function of a hearing device comprising an otoplastic individually shaped for a user intended to be using the hearing device to the needs of the user, said method comprising the steps of a) providing input data for each of a set of input parameters, an algorithm, and a set of target parameters, wherein at least a portion of said input data are individual to said user, and wherein said target parameters are parameters related to acoustical properties of the hearing device;

b) determining target data for each of the set of target parameters by applying said algorithm to said input data;

c) designing a suitable three-dimensional shape of said otoplastic in dependence of said target data by means of an otoplastic modelling software;

d) manufacturing said otoplastic according to said suitable three-dimensional shape; and e) obtaining property data using said otoplastic, wherein said property data are descriptive of properties related to said manufactured otoplastic, and at least a portion of said property data is descriptive of properties related to said otoplastic inserted in an ear of said user, said property data being at least one of:

a rest volume between an otoplastic and the ear drum of the user,
a feedback threshold of the hearing device,
an active insertion gain,
a passive insertion gain, and
an acoustic mass of a vent; and g) adjusting a transfer function of the hearing device dependent on the property data, wherein steps b)-e) are repeated at least once using the adjusted transfer function.

2. The method of claim 1, wherein at least some of the input data relates to one of an audiogram of said user, geometry of the shape of said user's ear canal, a type of hearing device to be manufactured, a description of listening situations, said user's history, or said user's acoustic preferences;

wherein at least some of the target parameters relate to one of acoustic impedance, acoustic mass, a vent type, a receiver to be used, a microphone to be used, insertion gain characteristics, or feedback threshold; and wherein at least some of the target data is one of a target active insertion gain, a target passive insertion gain, a target feedback threshold, a target acoustical vent mass, a target shape of said otoplastic, a target data of loudspeaker to be used, or a target data of a microphone or microphones to be used.

3. A method of manufacturing a hearing device comprising an otoplastic individually shaped for a user intended to be using the hearing device, said method comprising the steps of a) providing input data for each of a set of input parameters, an algorithm, and a set of target parameters, wherein at least a portion of said input data are individual to said user, and wherein said target parameters are parameters related to acoustical properties of the hearing device;

b) determining target data for each of the set of target parameters by applying said algorithm to said input data;

c) iteratively designing a three-dimensional shape of said otoplastic in dependence of said target data, wherein a final iteration of the three-dimensional shape fulfills a pre-determined criterion indicative of the three-dimensional shape achieving said target data;

d) manufacturing said otoplastic according to the final iteration of the three-dimensional shape;

e) obtaining property data using said otoplastic, wherein said property data are descriptive of properties related to said manufactured otoplastic, and at least a portion of said property data is descriptive of properties related to said otoplastic inserted in an ear of said user; and g) adjusting a transfer function of the hearing device dependent on the property data, wherein steps b)-e) are repeated at least once using the adjusted transfer function.

4. A method of manufacturing a hearing device comprising an otoplastic individually shaped for a user intended to be using the hearing device, said method comprising the steps of a) providing input data for each of a set of input parameters, an algorithm, and a set of target parameters, wherein at least a portion of said input data are individual to said user, and wherein said target parameters are parameters related to acoustical properties of the hearing device;

b) determining target data for each of the set of target parameters by applying said algorithm to said input data;

c) designing a suitable three-dimensional shape of said otoplastic in dependence of said target data by means of an otoplastic modelling software;

d) manufacturing said otoplastic according to said suitable three-dimensional shape, wherein said designing of step c) comprises:

k1) designing a preliminary three-dimensional shape of said otoplastic;

k2) determining, for said preliminary three-dimensional shape, achieved data for said target parameters;

k3) repeating steps k1) and k2) until a desired preliminary three-dimensional shape is identified, the desired preliminary three-dimensional shape fulfilling a pre-determined criterion indicative of an agreement between said achieved data and said target data; and k4) selecting the desired preliminary three-dimensional shape identified in step k3) as the suitable three-dimensional shape designed in step c) and manufactured in step d).

5. The method of claim 4, further comprising the steps of:

e) obtaining property data using said otoplastic, wherein said property data are descriptive of properties related to said manufactured otoplastic, and at least a portion of said property data is descriptive of properties related to said otoplastic inserted in an ear of said user, said property data being at least one of:

a rest volume between an otoplastic and the ear drum of the user,
a feedback threshold of the hearing device,
an active insertion gain,
a passive insertion gain, and
an acoustic mass of a vent; and f) amending said algorithm in dependence of said property data, wherein said amending occurs between an iterative determination of target data and comprises at least one of:

i) defining an amended set of input parameters, and
ii) defining an amended set of target parameters, wherein, as a result of amending said algorithm, a functional dependency of the target data on the input data is changed.

6. The method according to claim 5, wherein said amending mentioned in step f) is carried out also in dependence of said target data.

7. The method according to claim 5, wherein said amending mentioned in step f) is carried out also in dependence of said input data.

8. The method according to claim 5, wherein said amending mentioned in step f) is carried out also in dependence of said achieved data.

9. The method according to claim 5, wherein said amending mentioned in step f) comprises evaluating those data in dependence of which said amending of said algorithm is carried out.

10. The method according to claim 5, comprising the step of storing in a common storage unit at least a portion of those data in dependence of which said amending of said algorithm is carried out.

11. The method according to claim 5, wherein said amending mentioned in step f) is carried out also in dependence on said input data.

12. The method according to claim 4, wherein step k2) is carried out by said otoplastic modelling software.

13. The method according to claim 12, wherein said amending mentioned in step f) is carried out also in dependence on said achieved data.

14. The method according to claim 4, wherein step c) comprises the step of designing a shape and size of an opening in said otoplastic, wherein said opening is one of:

a vent;

a hollow in said otoplastic forming a channel from outside of the hearing device to an input transducer of the hearing device; and a hollow in said otoplastic forming a channel from an output transducer of the hearing device to the outside of the hearing device.

15. The method according to claim 14, wherein step c) comprises the step of designing the shape, size and a location of the opening in said otoplastic to the outside that forms a portion of the vent of said hearing device, and which is arranged between two portions of said vent that are enclosed by said otoplastic.

16. The method of claim 4, wherein at least some of the input data relates to one of an audiogram of said user, geometry of the shape of said user's ear canal, a type of hearing device to be manufactured, a description of listening situations, said user's history, or said user's acoustic preferences;

wherein at least some of the target parameters relate to one of acoustic impedance, acoustic mass, a vent type, a receiver to be used, a microphone to be used, insertion gain characteristics, or feedback threshold; and wherein at least some of the target data is one of a target active insertion gain, a target passive insertion gain, a target feedback threshold, a target acoustical vent mass, a target shape of said otoplastic, a target data of loudspeaker to be used, or a target data of a microphone or microphones to be used.

* * * * *